United States Patent [19]

Ibrahim et al.

[11] 4,341,083

[45] Jul. 27, 1982

[54] DOOR OPERATING MECHANISM FOR REFRIGERATED MERCHANDISER DISPLAY CABINET

[75] Inventors: Fayez F. Ibrahim, Niles; Elmer J. Subera, Cassopolis, both of Mich.

[73] Assignee: Tyler Refrigeration Corporation, Niles, Mich.

[21] Appl. No.: 145,711

[22] Filed: May 1, 1980

[51] Int. Cl.[3] ..... A47F 3/04

[52] U.S. Cl. ..... 62/82; 49/340; 62/256; 62/282

[58] Field of Search ..... 49/322, 340 X; 312/109, 312/110, 116, 138 R, 139; 62/255, 256, 151, 282 X, 82

[56] References Cited

U.S. PATENT DOCUMENTS 2,987,782 6/1961 Kurowski ..... 312/138 R 3,141,662 7/1964 Wise ..... 49/340 X

*Primary Examiner*—Lloyd L. King

*Attorney, Agent, or Firm*—LeBlanc, Nolan, Shur & Nies

[57] ABSTRACT

An improved refrigerated merchandiser cabinet for food products storage and displaying which is equipped with transparent barrier doors which are openable by a door operating mechanism which selectively creates a gap between the door and the covered access opening to permit flow-through of ambient air for use during the defrost cycle. The door operating mechanism also permits the gap to be closed by imposition of an outside force by provision of a motion take-up means. Normal product entry and customer usage is provided for. Operation of the refrigerated cabinet with either a single or multiple air bands during a refrigeration cycle is provided for. During the defrost cycle a number of ambient air flow patterns can be employed, including the use of an auxiliary air fan. Reversal of the air band flow pattern during a defrost cycle is provided for. The method of operating the improved refrigeration display cabinet is also included.

54 Claims, 8 Drawing Figures

DOOR OPERATING MECHANISM FOR REFRIGERATED MERCHANDISER DISPLAY CABINET

BACKGROUND OF THE INVENTION

The present invention relates to a "reach-in" merchandiser type of refrigerated display case or cabinet used primarily in retail food and supermarket outlets. The term "refrigerated", in accordance with the present invention, is intended to incorporate those cases maintained at a temperature at or in excess of 32° F., such as display cases utilized for display of milk and fresh foods, and those cases maintained below 32° F., such as frozen food cases. In addition, references are made herein to the use of transparent doors, since those are the types of doors most frequently utilized in such retain outlets. Other types of doors could also be employed within the scope of the present invention.

In the operation of all types of refrigerated display cabinets, it is desirable to include a system for automatically defrosting the refrigeration coils. The defrost cycle can be actuated either as set periodic time intervals or when the frost buildup within the system has reached a certain predetermined level. Such systems are typically thermostatically controlled so as to switch from a refrigeration cycle to a defrost cycle of operation. In this manner of operation, it is possible to avoid any significant frost buildup within the display cabinet such that inoperability and spoilage of food products would occur.

There have been three different approaches for defrosting refrigerated display cabinets in this art. These are, utilizing electric resistance heaters; passing a compressed refrigerant gas having a high specific heat through the refrigeration coils; and, circulating ambient air through an air conduit in which the refrigeration coils are positioned. Due to the increased cost of energy, efforts have been made to place more emphasis on the utilization of ambient air defrost systems as an alternative to the electrical resistant heaters or compressed refrigerant gas defrost systems.

This invention relates to a "reach-in" transparent door merchandiser type of refrigerated display cabinet having an air defrost system incorporated therein. It also relates to the disclosures made in application Ser. No. 101,069, filed Dec. 7, 1979, now U.S. Pat. No. 4,265,090; an application entitled REFRIGERATED MERCHANDISER DISPLAY CASE ADAPTED FOR ENERGY CONSERVATION, Ser. No. 141,359 filed Apr. 18, 1980; and an application entitled REFRIGERATED MERCHANDISER DISPLAY CASE, Ser. No. 141,360 filed Apr. 18, 1980 all of which have a common assignee with the present application. The disclosures of all of these applications are hereby incorporated by reference as though fully set forth herein.

One type of system which employs ambient air during a defrost cycle is exemplified by U.S. Pat. Nos. 3,403,525; 3,850,003 and 3,937,033, all to Beckwith et al. These systems use fans separate and distinct from the main circulating fans to move ambient air across the refrigeration coils for defrosting. The additional fans are turned on only during the defrost cycle of operation for pulling ambient air from the outside of the display cabinet directly into the air conduits located within the walls of the cabinet. A second type of system is illustrated in U.S. Pat. No. 3,082,612 to Beckwith, which system draws ambient air into the main circulation path through the ports located in the lower front panel of the refrigerated display cabinet. Such ports are normally closed during the refrigeration cycle and opened during the defrost cycle. The Beckwith et al 3,850,003 patent indicates that the concepts described in patent Nos. 3,082,612 and 3,403,525 did not prove to be practical and hence were not commercially feasible.

Another type of ambient air defrost system is shown in U.S. Pat. No. 4,144,720 issued to Subera, et al which is assigned to the same assignee as the present application. In the Subera patent, an open-front refrigerated display case having primary and secondary air conduits is disclosed. In this system, the direction of the air flow within one of the conduits is reversed, for example, by the use of reversible fans to provide ambient air defrost. U.S. Pat. No. 4,026,121 to Aokage, et al, which illustrates an open-front display case, and U.S. Pat. No. 4,120,174 to Johnston, which illustrates an open-top display case, also disclose reverse ambient air flows for defrosting.

In those ambient air defrost systems disclosed in the above-noted patents which use a reverse air flow, during the defrost cycle of operation, ambient air can easily be drawn through the access opening of the case or cabinet into the air conduit through the outlet opening of the air conduit and then expelled from the air conduit after the defrost operation through the inlet opening and then forced out of the cabinet through the unblocked access opening. Such an arrangement, however, cannot be readily used in a refrigerated merchandiser display case having barrier doors, since the front opening in the cabinet is covered by the doors. Thus, in order to employ an ambient air defrost system, a different type of system had to be conceived.

In seeking to employ ambient air defrost techniques in cases having doors, systems have been developed for drawing air over a limited portion of the air conduit by opening flaps into the conduit, which flaps are arranged so as to straddle the evaporator coils of the refrigeration mechanism. Such systems are disclosed in U.S. Pat. No. 3,226,945 to Spencer and U.S. Pat. No. 4,072,488 to Johnston. The patent to Spencer illustrates a plurality of different embodiments of open-top refrigerated display cases, both of the single shelf and multi-shelf types, in which the air flow is always drawn over evaporator coils in a single direction under negative pressure. During the refrigeration cycle of operation, air after being refrigerated is circulated through the air conduit and into the display section of the case. The patent to Johnston discloses a glass door type merchandiser display cabinet in which air is circulated through the air conduit and through the evaporator coils arranged within the air conduit in such a direction that cold air enters the display space at the bottom of the cabinet and is then drawn up into the air inlet located near the top of the cabinet. For defrosting, top flaps are opened since this case is designed with coils at the top. This shows a somewhat complicated way to provide both glass doors and air defrost features according to the prior art. Such systems are relatively complex and can involve certain operational problems, particularly due to frost and dust accumulation. Where there are moving parts inside of the air conduit an accumulation of frost on such parts can cause them to stick and hence not function properly.

The prior art as represented by the patents discussed above has treated the opening of the barrier doors on such merchandiser refrigerated cabinets as being only a problem as illustrated by Johnston, U.S. Pat. No. 4,072,488 which describes the frost buildup due to the opening of the cabinet doors.

The prior art does not appear to have viewed the opening of the doors as a possible solution to the defrosting requirements.

The background of the invention described and claimed in the present application also includes a recognition of the energy conservation trend among managers of retail food outlets to reduce operating costs wherever possible. One such area of energy conservation is to provide heat transfer constraining barrier doors across the refrigerated merchandiser display cabinets. Such barrier doors are often constructed of double or tripple layer glass or other transparent materials in order to reduce the contact between the ambient air which has high heat and moisture content and the refrigerated air within the display cabinet.

During periods of high door openings frequency for shopping or stocking the case or when the store ambient heat and humidity levels are elevated the refrigerated air band which may be at a temperature as low as −15° F. is contacted by ambient air having a temperature as high as 75° F. This contact can raise the refrigeration load even above that required by multi-air band open front cases having no barrier doors. To solve this problem, it is optimum to employ one or two guard air bands which can protect the inner refrigerated band against direct contact with the ambient air when the merchandiser doors are opened.

Beckwith et al U.S. Pat. No. 3,403,525 also discloses a night curtain which is to be placed over the normally open access area of a refrigerated case in order to reduce energy consumption during the "non-sales" hours, but with this arrangement no air defrost or customer entry is possible.

Vogel, U.S. Pat. No. 4,117,698, discloses a retractable night curtain for use during closed store hours during which no provision is made for customer entry.

SUMMARY OF THE INVENTION

An improvement in refrigerated cases is provided in which provision is made for one or more circulated air bands, an air defrost means, and a door operating mechanism which functions to selectively create a gap between a barrier door and the associated access opening to effect defrosting in a simple and low energy consumption manner. The door operating mechanism also permits the gap to be closed without breakage since customers and store personnel have a tendency to close the partially opened door.

The air defrost means also includes an air moving means for passing ambient air through the cabinet and through the gap held between the door and the access opening to bring the ambient air into contact with refrigeration elements in the cabinet to remove accumulated frost therefrom and to thereafter eject the defrost ambient air from the cabinet. The gap created between the barrier door and the access opening is thus part of the flow path of the ambient air being passed through the refrigerated cabinet to effect the defrosting function. Temporary closing of the gap by customers is operatively provided for by this disclosure.

The invention encompasses the use of such an air defrost means to selectively create a gap between the barrier door and the access opening of refrigerated display cabinets having only a single circulated, refrigerated air band propelled within an air conduit or having a plurality of circulated air bands therein of the type which are often used in food outlets without heat transfer barrier doors. When a plurality of air bands are included in the cabinet one of these will function as a guard band and can be operated only when needed due to expected or actual use conditions in the store.

It is, therefore, an object of the present invention to provide an improved ambient air defrost means for a refrigerated display cabinet having a customer access opening therein covered by a movable door which provides for low energy consumption operation.

Another object of the present invention is to provide a refrigerated display cabinet having a door operating mechanism which selectively creates a gap between a barrier door and the access opening covered by the door in order to provide for ambient air passage through the cabinet for defrosting purposes.

Still another object of the present invention is to provide a door operating mechanism which accommodates closing of the gap in an operative manner.

A still more specific object of the present invention is to provide a glass door merchandiser refrigerated display cabinet utilizing an improved ambient air defrost system wherein during the defrost operation ambient air is drawn into the cabinet and circulated through at least a substantial portion of the primary refrigerated air conduit and is thereafter expelled from the cabinet by utilizing an air flow path which passes through a gap created between the glass door and an access opening which is covered by the door.

Specific preferred embodiments of the invention will be described below with reference to the appended drawing figures.

DESCRIPTION OF THE PREFERRED EMBODIMENTS

Figure 1:
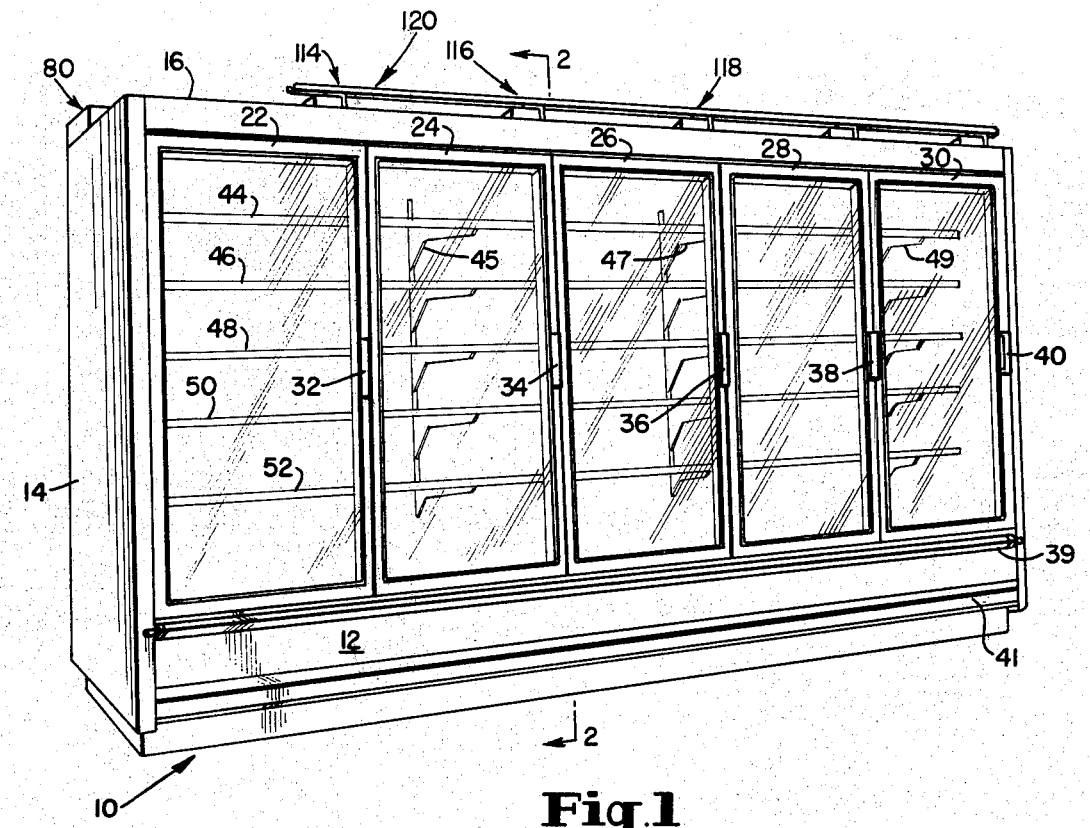
FIG. 1 is a perspective schematic view of a refrigerated display cabinet equipped with the door operating mechanism of the present invention.
Figure 2:
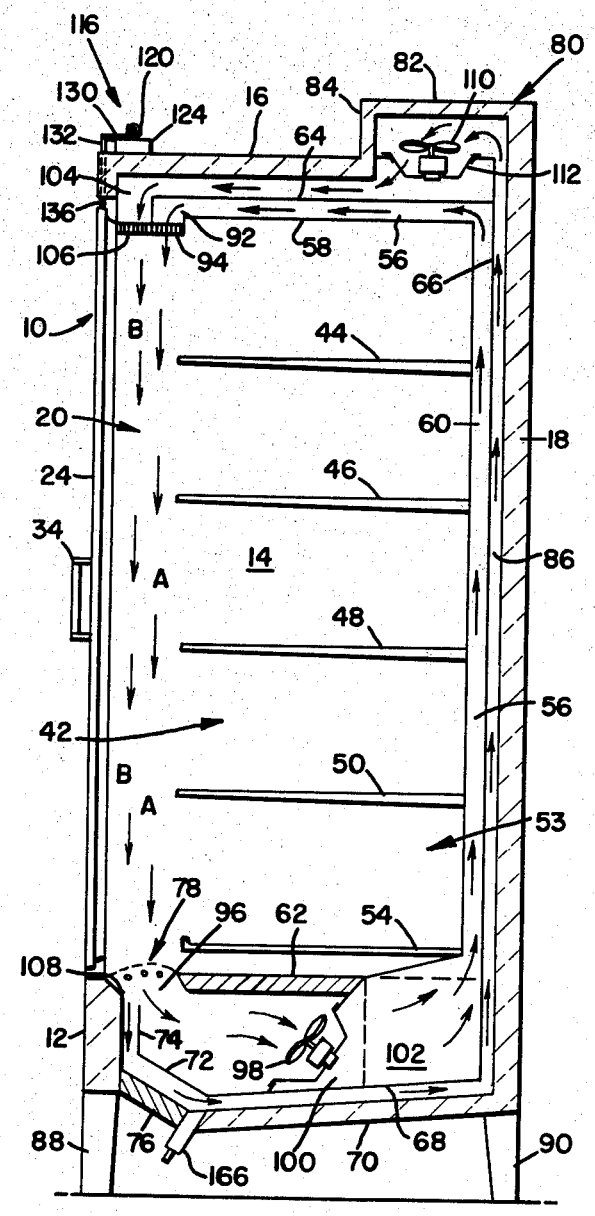
FIG. 2 is a schematic cross-sectional view of the refrigerated display cabinet shown in FIG. 1 taken on the line 2—2 and showing the cabinet in a refrigeration cycle of operation with two circulated air bands.
Figure 3:
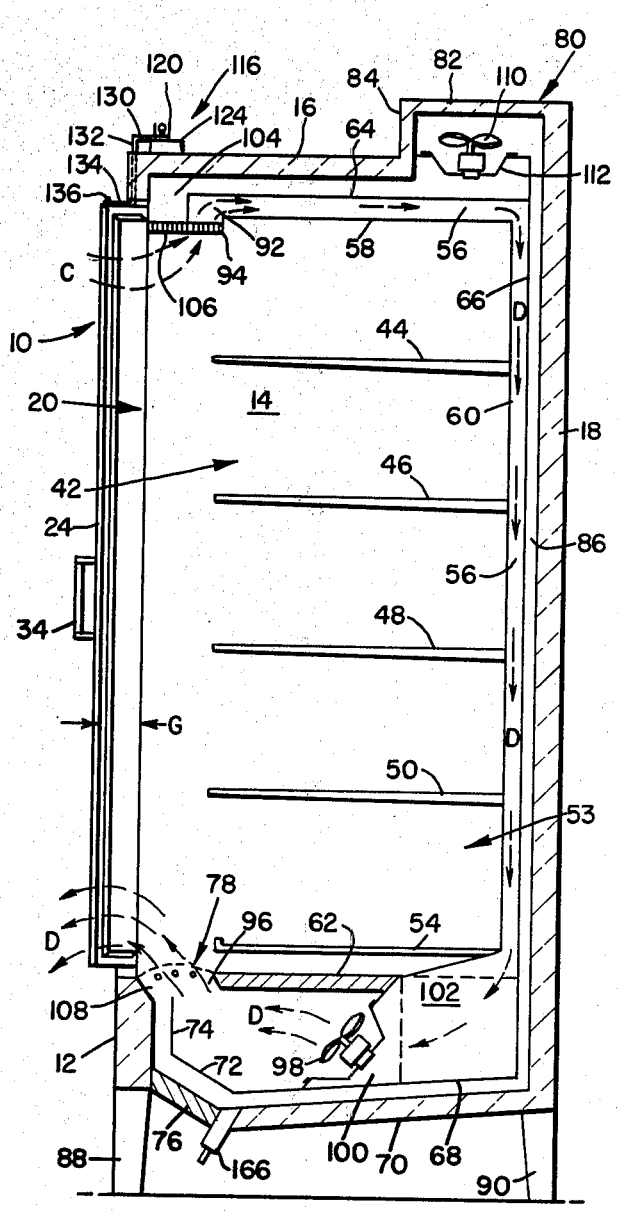
FIG. 3 is a schematic cross-sectional view of the display cabinet shown in FIG. 2 when in a defrost cycle of operation.

Referring to FIGS. 1–6, an upright refrigerated display cabinet or case assembly, generally indicated as 10, has a front wall 12, side walls 14, top wall 16 and an insulated rear wall 18, which are best shown in FIGS. 2 and 3. Display case 10 has an opening 20 in its front wall 12 which is covered by one or more barrier doors illustrated by five doors 22, 24, 26, 28 and 30. Each door is attached to the display cabinet by vertical hinge pins shown as 31 in FIG. 4 and each door has a handle shown as 32, 34, 36, 38 and 40 respectively. Upper and lower bumper guard rail 39 and 41 are also provided on front wall 12. Such a refrigerated display cabinet is typically referred to as a glass-door merchandiser even though transparent material other than glass such as plastic can be used in the doors. Merchandiser refrigerated display cabinets can be used for storing either fresh foods, such as dairy products, or frozen foods requiring lower temperature.

The interior of the display cabinet shown in FIG. 2 has a display space 42 in which there are arranged a plurality of display shelves 44, 46, 48 and 50, although more than four such shelves can be employed as illustrated by shelf 52 in FIG. 1.

Each shelf can be supported by a plurality of vertically adjustable support brackets 45, 47, and 49 as shown for shelf 44 in FIG. 1. The space at the bottom of the shelves can be used as a storage space 53 and can have a shelf 54 at the bottom thereof as shown in FIGS. 2 and 3. Access to the refrigerated products on the display shelves is provided to customers and employees by opening one or more of the doors and reaching into the case through access opening 20.

Disposed about display space 42 in FIGS. 2 and 3 is a primary air conduit 56 which is formed on the interior side by top panel 58 rear panel 60 and bottom display panel 62 which also form the interior surfaces of display space 42. The primary air conduit 56 is formed on the exterior side by an upper divider panel 64 which is connected along the rear edge thereof to a vertical divider panel 66 which extends downwardly and parallel to rear panel 60. Both panel 64 and 66 are shown, constructed of sheet metal although laminates of metal, plastic, and insulation can be used. Vertical divider panel 66 is connected along the lower edge thereof to bottom separator panel 68 which extends above and spaced away from bottom insulated panel 70. Bottom separator panel 68 is connected at the front edge thereof as shown in FIGS. 2 and 3 to an inclined front separator panel 72 which is, in turn, joined to a substantially vertical front divider panel 74. An inclined bottom member 76 is connected to the front edge of bottom panel 70 and is connected at its front most edge with the bottom of front wall 12 which extends upwardly and provides front support for an air grille 78 which then extends from the front wall 12 in an arcuate fashion into bottom storage space 53.

The bottom rear edge of bottom panel 70 is connected to rear wall 18. The top portion of rear wall 18 and part of top wall 16 incorporate a secondary air conduit fan housing 80 which is constructed of a top panel 82 connected along the top edge of rear panel 18 and along the front edge thereof to vertical exterior member 84 which is connected by the lower edge thereof to top panel 16. The outermost conduit formed between top wall 16 and upper divider panel 64 at the top of the cabinet and extending vertically downward between divider panel 66 and rear panel 18 forms a secondary air conduit 86 which extends between bottom separator panel 68 and bottom panel 70 in the lower portion of the cabinet. Support feet 88 and 90 are also provided for bottom wall 70.

Primary air conduit 56 terminates at its upper end in a primary conduit outlet opening 92 in which are arranged downwardly oriented directional louvers 94. At the opposite end of primary air conduit 56 an air inlet opening 96 is provided immediately below grille 78 and functions as an air intake for the primary air band indicated by arrows A. Outlet opening 92 and inlet opening 96 are thus arranged in aerodynamic alignment for the primary air band. The primary air band A is circulated by motor-driven primary fan 98 which is positioned in the bottom portion of primary conduit 56 and is supported therein by a baffle plate 100. Also positioned within conduit 56 are one or more evaporator coils of a refrigeration means indicated schematically as low temperature element 102. This refrigeration means consists of a sheet metal box in which a plurality of refrigeration evaporation coils are arranged. The sheet metal sides have openings to allow for passage of one or more air band as illustrated in FIGS. 2 and 3 by the air flow arrows and perforations. The primary air band propelled through conduit 56 by fan 98 is maintained in a refrigerated, low temperature condition during the refrigeration cycle of operation of cabinet 10.

The upper front portion of secondary air conduit 86 formed between upper separator panel 64 and top wall 16 terminates in a seconary air conduit outlet opening 104 in which are positioned downwardly oriented directional louvers 106 which function to direct the air flow downwardly across the inside of door 24 as shown by the secondary air guard band indicated by arrows B in FIG. 2. The secondary air band enters air grille 78 at the bottom portion of door 24 and then into a secondary conduit air inlet opening 108 which is associated with air grille 78. The inlet and outlet openings of the secondary air conduit are also positioned in aerodynamic alignment. This secondary air inlet opening is separated from the primary conduit inlet opening 96 by the top front portion of front divider panel 74. During the refrigeration cycle of operation shown in FIG. 2 the secondary air band B is propelled downward through the outlet opening 104 and into inlet opening 108 and then between front separator panel 72 and inclined bottom member 76 and thereafter between separator panel 68 and bottom panel 70 then upwardly in conduit 86 between vertical divider panel 66 and rear wall 18 by means of a motor-driven secondary conduit fan 110 mounted in baffle 112 positioned within fan housing 80 at the top of the case 10.

FIG. 1 shows door operating mechanisms 114, 116, and 118 affixed on top wall 16. As will be appreciated from the later described functioning of these door operating mechanisms, a single such mechanism could be arranged to open each door separately or, alternatively, all of the five doors shown on cabinet 10 in FIG. 1. In the specific embodiment shown in FIGS. 1–6 mechanisms 114, 116, and 118 are electric motor and reduction gear box assemblies which operate a lever system to open doors 22-30. These door operating mechanisms are connected through separate transmission linkages to a common operator rod or channel 120 and can be described by reference to one of these mechanisms.

Figure 4:
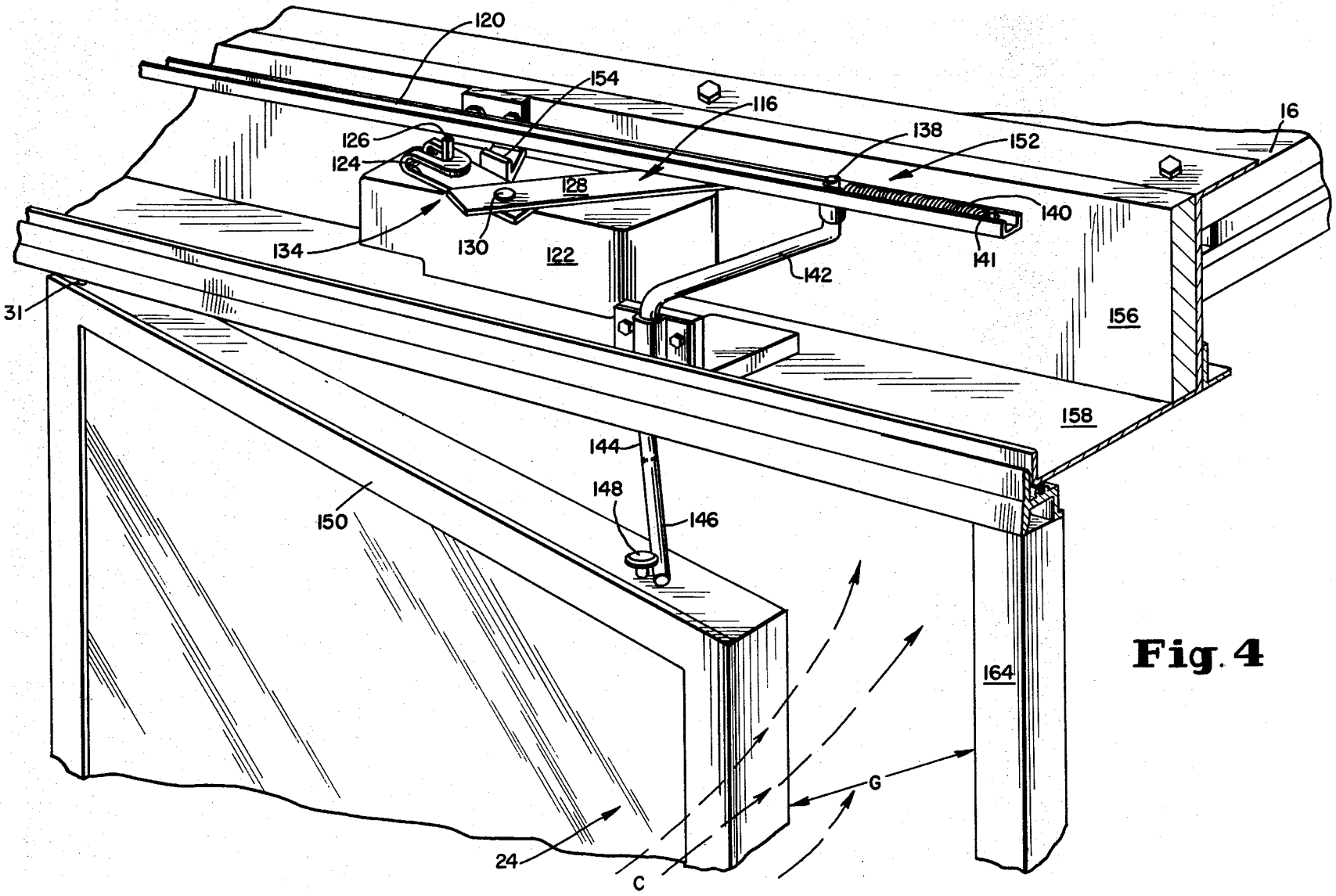
FIG. 4 is a close up perspective view of the door operating mechanism with a door shown in partially open position.
Figure 5:
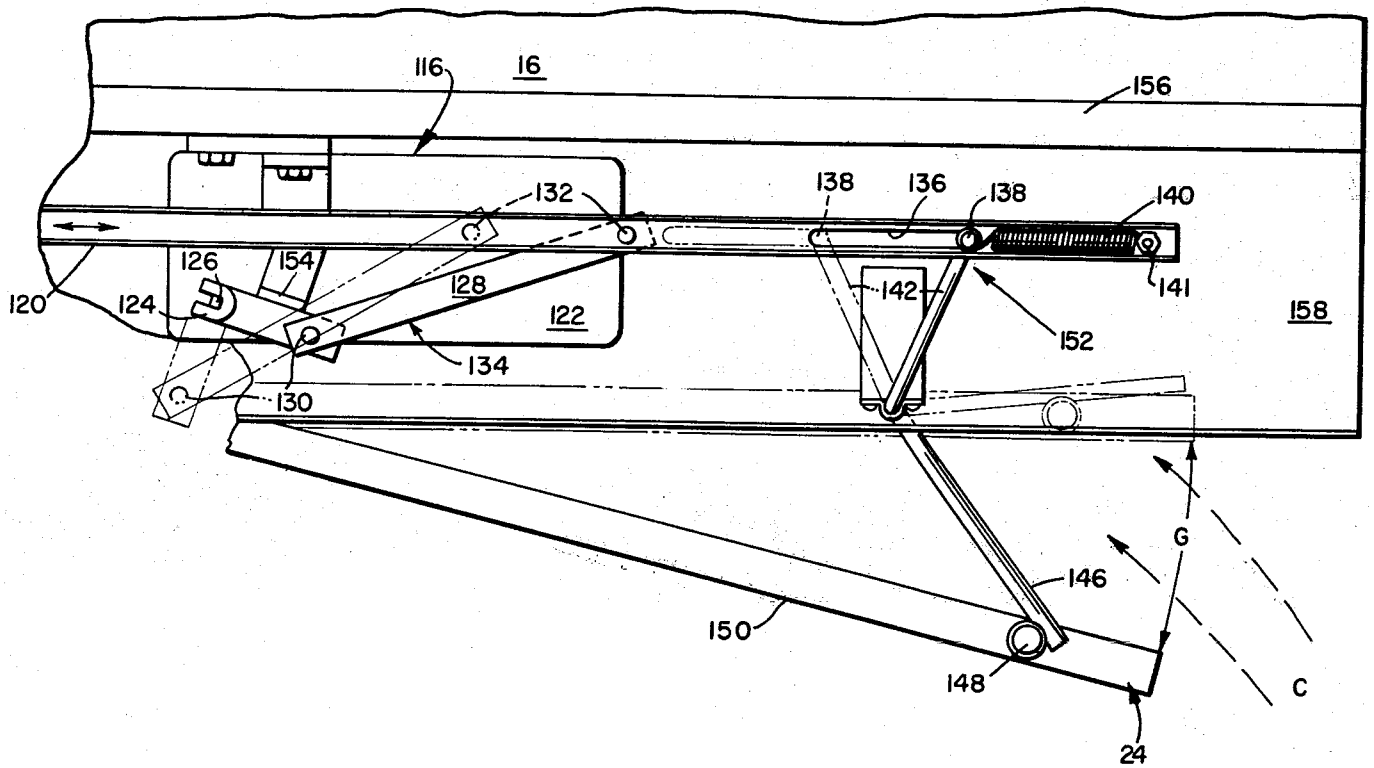
FIG. 5 is a top plan view of the door operating mechanism shown in FIG. 4.

Door operating mechanism 116 is best shown in FIG. 4 wherein a electric motor and gear box assembly 122 is mounted adjacent top wall 16 and has a swing arm 124 crimp-attached to its output shaft 126. Arm 124 is pivotally linked at its opposite end to member 128 by hinge pin 130. Member 128 is, in turn, pivotally linked to operator rod 120 by a pivot pin 132 shown in FIG. 5. The swing arm 124, hinge pin 130 and member 128 form a power transmission linkage means 134. Operator rod 120 is formed in a channel-shaped cross-section and has a motion take-up slot 136 formed therein for slidably retaining a follower pin 138. As shown in FIGS. 4 and 5 follower pin 138 is forced against the right-hand end of slot 136 by tensile force exerted by tension spring 140 which is retained by fixed pin 141 relative to operator rod 120. The follower pin is integrally connected to door lever arm 142 which is, in turn, connected to a vertical rotatable connection rod 144. A door opening lever 146 is affixed to the bottom end of rod 144 for contacting door 24. As shown in FIGS. 4 and 5, a stud 148 is provided on top of door frame member 150 as a contacting member for door opening lever 146.

Door operating mechanism 116 functions under power from the motive means 122 as follows. Upon switching of the operation of cabinet 10 to a defrost cycle, motor and gear box assembly 122 is activated to rotate output shaft 126 which causes power transmission linkage 134 to extend to the position shown in FIG. 4 which is also the position shown in solid lines in FIG. 5. As the transmission linkage 134 changes position, operator rod 120 moves to the right and spring 140 retains follower pin 138 at the right-hand end of slot 136. Door lever arm 146 then rotates rod 144 in order to force door opening lever 146 against stud 148 whereby the door 24 is partially opened by the door operating mechanism 116.

In the event that a customer or employee intentionally or accidentally applies an outside force against door 24, the door opening lever 146 will move toward the closed door position and follower pin 138 will slide within slot 136 against the tensile force of spring 140 so that door lever arm 142 will move to the position shown by dotted lines in FIG. 5. The transmission linkage 134 will remain in the position shown by the solid lines in FIG. 5 since the door closing will be accommodated by the motion take-up means 152 formed by slot 136, follower pin 138 and spring 140.

The exact position of transmission linkage 134 when extended is determined by a stop member 154 affixed to top cowl 156. Supports (not shown) for slidably engaging operator rod 120 can also be affixed to cowl 156 or the door jamb 158, if desired, but operator rod 120 can be adequately supported by a plurality of transmission linkages when more than one motor is used. During movement of operator rod channel 120 toward the right both the predominant longitudinal and a slight transverse motion are prescribed. The transverse motion can be held to a minimum by making slot 136 wider than the diameter of follower pin 138. This pin describes an arc during its movement between the positions shown in FIG. 5 and provision for this motion must be made in either the width of slot 136 or by permitting transverse motion of operator rod 120. This latter motion is accommodated within transmission linkage 134 by hinge pin 130 and pivot pin 132.

As briefly mentioned above, a single door operating mechanism can be used for each door such as partially illustrated by FIGS. 4 and 5. It is also possible to use a single motor and gear box assembly for powering the operator rod 120 for opening all of the doors simultaneously. Another preferred embodiment is shown in FIGS. 1 and 6 wherein three motor and gear box assemblies are ganged on one side of cabinet 10 and used to open the five doors, although in the latter figure, only three doors are shown.

Figure 6:
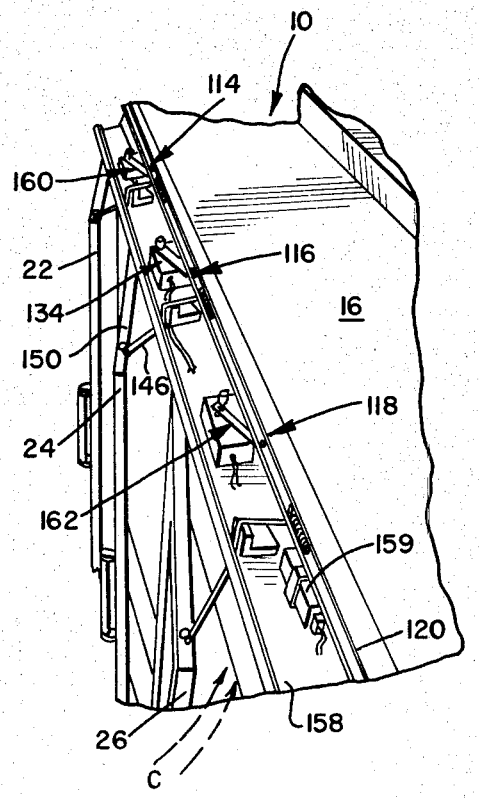
FIG. 6 is a top perspective longitudinal schematic view of the display cabinet shown in FIG. 1 wherein three motive means are shown for powering the door operating mechanism.

FIG. 6 shows operator rod 120 extending in longitudinal alignment with jamb 158 and supported by three transmission linkages assemblies 160, 134, and 162, for door operating mechanism 114, 116, and 118, respectively. Doors 22, 24, and 26 are shown in partially opened positions since operator rod 120 has been moved longitudinally along door jamb 158 by the door operating mechanism 114, 116, and 118 operating simultaneously. When the motor and gear box assemblies are positioned on the left hand side of cabinet 10 the space immediately over jamb 158 on the right hand side can be used for other equipment such as light ballasts 159. Alternatively, the door operating mechanism could be equally spaced across the cabinet 10.

As a specific disclosure of engineering details for a 5-door, 12 feet cabinet, the motor in motive means 122 can be a 9 watt Dayton damper motor operating from either 110–115 volts or 220–230 volts lines. These motors develop 15 pounds output force for a total of 45 pounds as illustrated in FIGS. 1 and 6. This gives 9 pounds of force per door which has been found sufficient. The tension spring 140 can be of 12 pound tensile force in order to provide an additional force to break the magnetic seals positioned about the doors or, if desired, up to about 20 pound tensile springs can be used. Only two motors of this type are needed for the three-door, 8 feet cabinets. An advantage of the use of multiple motors to power a common operator rod 120 is that the system remains operative with fewer than all motors functioning. Other configurations for the door operating mechanism are that a plurality of solenoids can operate directly against the doors to open the same or a single solenoid operating a multiple cam arrangement can open all doors or only selected doors. The motion take-up means for these configurations can be provided by springs placed in the line of force transmission from the motive means.

Door operating mechanism 116 and the associated arms, rods and linkages provide a door operating mechanism for selectively creating a gap between the barrier door 24 and the access opening 20. In the defrost cycle of operation of cabinet 10 ambient air is drawn into and/or expelled out of the cabinet 10 through the gap G formed between door 24 and door mullion 164 shown in FIG. 4. This ambient air inflow is shown by dashed arrows C in FIGS. 3–5.

A preferred mode of defrost operation of cabinet 10 is shown in FIG. 3 wherein door 24 has been opened by door operating mechanism 116 and ambient air (illustrated by dashed arrows C) is drawn through the upper portion of the gap G into the primary air conduit outlet opening 92 and into the primary air conduit 56 by means of the primary conduit fan 98 being operated in reverse direction from that shown in FIG. 2 for the refrigeration cycle of operation. The ambient air thus drawn into cabinet 10 is propelled through the primary conduit 56 as shown by the dashed arrows around the periphery of display space 42 downwardly in the rear portion of the primary conduit 56 and between bottom panel 62 and bottom separator panel 68 and then up to the front of the primary conduit 56. The primary air band with the entrained ambient air C is then caused to continue flowing upward and outward of cabinet 10 through the lower portion of gap G, created between door 24 and access opening 20. During this defrost cycle the warmer ambient air raises the temperature of the air flowing in the primary conduit and melts the frost and ice which has accumulated on refrigeration element 102. The secondary conduit fan 110 is not operated during this preferred defrost cycle and hence secondary air flow is dormant.

The reversed flow air system arrows have been labeled D in conduit 56 after contact with element 102 since the primary conduit air band is then a defrost ambient air band. If desired, the speed of the primary conduit fan 98 can be increased during this reverse flow and/or the pitch of the blades can be set to move a greater volume of air in the reverse, defrost direction than in the refrigeration cycle shown in FIG. 2 to provide quicker defrost. A 25% to 50% greater air flow during defrost can be achieved in this manner. The water created by this defrost action is then drained from the bottom of cabinet 10 by drain 166 which is arranged at the convergence of the downward sloping bottom panel 70 and inclined bottom member 76.

At the termination of the defrost cycle the control means operates door operating mechanism 116 to allow door 24 to close and for fan 98 to then reverse its direction to re-establish the primary, refrigerated air band A shown in FIG. 2. At the same time secondary fan 110 can be engaged for operation under one of the operating alternatives as described below.

A plurality of conduit fans illustrated by primary conduit fan 98 and the secondary conduit fan 110 shown in FIGS. 2 and 3 are spaced along the length of cabinet 10 shown in FIG. 1. For example, two each of these fans are normally provided for an eight foot long case or three each of the primary and secondary fans are provided for a twelve foot case. By way of example, but not limitation, the overall height of cabinet 10 is approximately 82 inches and the width is approximately 45 inches. Such cabinets are manufactured in lengths up to 72 feet.

MODES OF OPERATION

The operation of motor driven fans 98 and 110, refrigeration element 102, and door operating mechanism 116 is controlled by a control means which selectively operates these elements of cabinet 10 in a refrigeration cycle and then in an alternate defrost cycle. The control means receives signals from condition and time sensors and switches operation of cabinet 10 between the two cycles. The operation during the defrost cycle is controlled by an air defrost means which opens the doors and controls the air moving means, fans 98 and 110. At the termination of the defrost cycle, the air defrost means controls the door operating mechanisms such as 114, 116, and 118 to close the doors and the fans 98 and 110 to revert to the refrigeration operation. The control means then takes over operations and activates the refrigeration means 102. The control means can be fabricated from conventional components, although arrangement of these components can result in several degrees of freedom in the operation of the cabinet. The control means can function during the refrigeration cycle as shown in FIG. 2 wherein air fans 98 and 110 are continuously operated and refrigerant is evaporated in low temperature element 102 as needed in order to maintain the low temperature required by products stored in display space 42. During the refrigeration cycle the door is closed as shown in FIG. 2.

An alternate mode of operation can be provided for fan 110 during the refrigeration cycle. Door switches can be provided for operation by any of the doors so that the secondary conduit fan 110 closest to the access opening covered by that door will be activated upon the opening of the door. For this purpose a switch can be installed within cabinet 10 to be operated when the door is open. Another variation is that the opening and closing of the doors by customers and employees can be used as numerical input to an electronic counting circuit so that the secondary fan 110 is operated whenever a particular frequency of openings per time period is exceeded. In his manner cabinet 10 can be provided with a control means which is responsive to the shopping demand placed on the unit. This type of sensing means to provide signals for the control means can be provided for all barrier doors or for only spaced and selected doors. The sensing switches can be set so that they do not sense the defrost cycle opening of the doors by the door operating mechanisms.

Yet another variation can be the operation of secondary fan 110 depending upon the temperature and humidity conditions in the ambient store air or in the cabinet display space.

The defrost cycle of operation for cabinet 10 can be initiated by sensing the temperature at locations spaced slightly away from the coils in low temperature element 102 so that the build-up of a predetermined thickness of frost and ice on the coils will activate the sensing element which can then initiate a defrost cycle. Another means is a timer which controls the defrost cycles initiations at set intervals. Other variations are to record store ambient conditions, particularly relative humidity, and to vary the time cycle of defrost depending on such conditions. The number of openings of the cabinet doors can also be included as a control feature as above described and referenced to the operation of the secondary conduit fan 110.

The following actions occur when a defrost cycle is initiated. The refrigerant evaporation in low temperature element 102 is terminated; door operating mechanism 116 is operated to open the doors as illustrated in FIG. 5; secondary conduit fan 110 is preferably stopped; and primary conduit fan 98 is reversed so that the air flow pattern is as shown in FIG. 3, whereby ambient air enters the top portion of the gap created between the barrier door 24 and the access opening 20 and then ambient air flows through primary conduit 56 in a reverse direction in order to contact the frost and ice coated coils in low temperature element 102 and thereafter the resultant defrost ambient air is expelled from the botton portion of the gap as shown. The defrost cycle can continue until a preset time is exceeded or a temperature measurement can be taken in the close proximity of the coils in low temperature element 102 so that the defrost cycle is terminated when that sensed point in element 102 reaches a predetermined temperature, for example 50° F., for which purpose a sensor known as a Klixon can be employed.

The door operating mechanisms 114, 116, and 118, etc. can be arranged to open the cabinet barrier doors 24, 26, 28, etc. with several degrees of freedom: (1) all doors can be opened simultaneously as illustrated; (2) those doors having high customer demand use can be opened more frequently for defrost since the closest evaporator coils cooling the primary air band will accumulate more ice; (3) individual doors or a selected sequence such as alternate doors in the plural series of barrier doors can be opened for the defrost cycle; (4) the doors can be opened by predetermined gap distances such as 1 to 7 inches by way of preferred example or by a variable gap distance depending on the defrost condition and ice accumulation which can be used to define the ambient air intake requirement; and (5) the defrost cycle initiation and gap creation by the air defrost means including the door operating mechanism can be controlled by the need for defrosting as determined by frost and ice buildup sensed on the low temperature element 102. For operations 2 and 3, above separate operating mechanisms such as shown by FIGS. 4 and 5 are needed for each door.

ALTERNATIVE EMBODIMENTS

Figure 7:
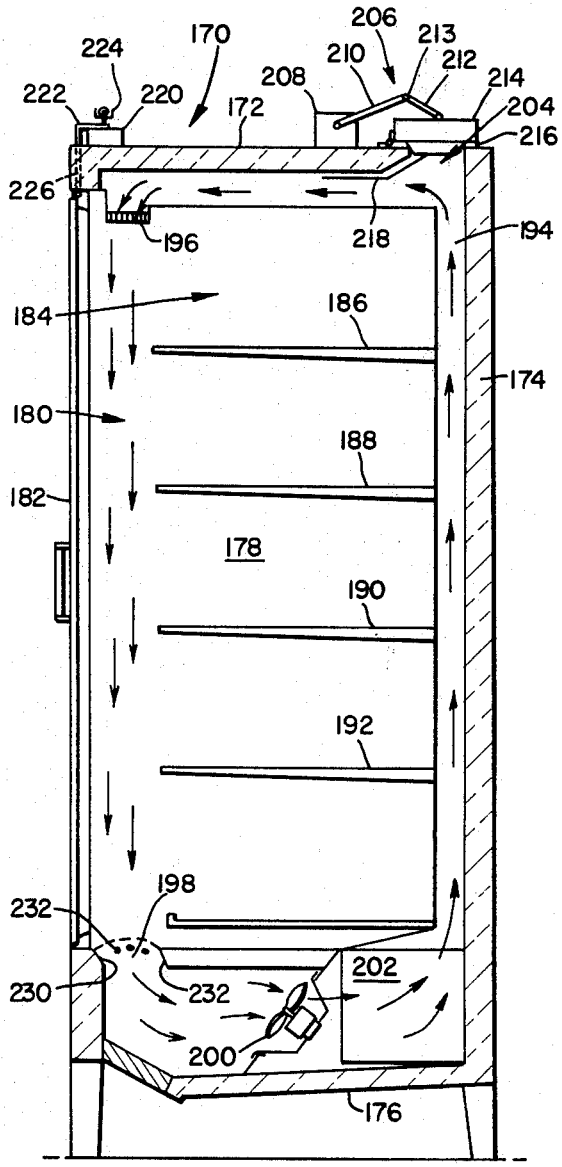
FIG. 7 is schematic cross-sectional diagram of a second modification of a refrigerated display cabinet having a single circulated air band and shown in a refrigeration cycle of operation.
Figure 8:
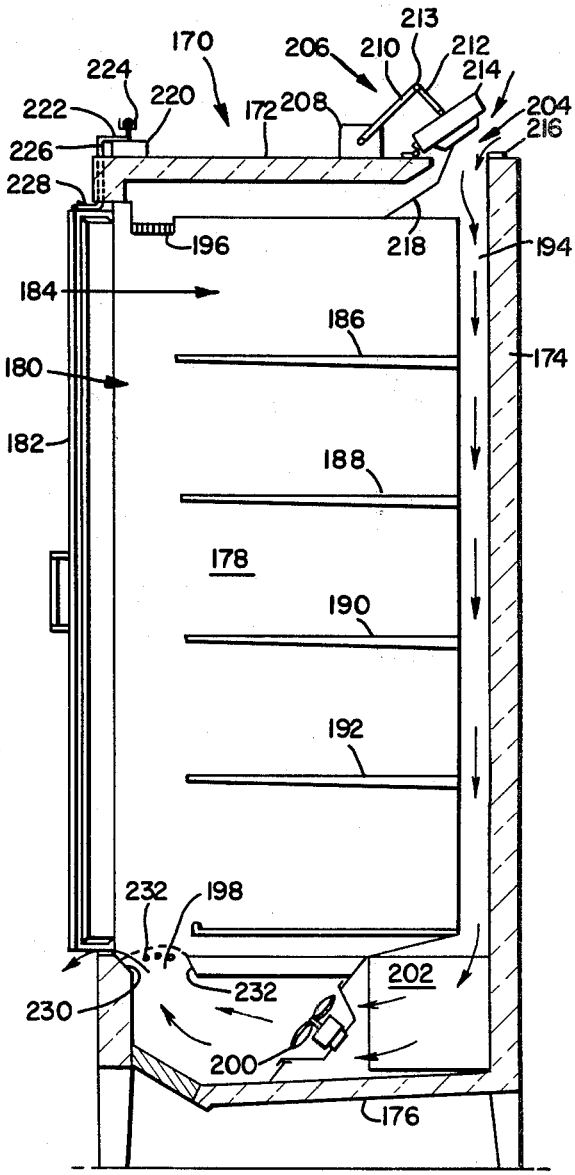
FIG. 8 is a schematic cross-sectional diagram of the refrigerated display cabinet shown in FIG. 7 when in a defrost cycle of operation.

Referring to FIGS. 7 and 8, a refrigerated display case 170 has a top wall 172, a rear wall 174, a bottom wall 176 and two side walls 178. Display case 170 has an access opening 180 in its front which is covered by either a single or a plurality of glass doors 182. Each door is attached to the display case by a pair of hinge pins located at the top and bottom of door 182 similarly to pin 31 in FIG. 4 above. These hinge pins can be spring biased for closing. Such a display case is typically referred to as a glass door merchandiser. A glass door merchandiser refrigerated display case can be used for storing either fresh foods, such as diary products, or frozen foods.

The interior of the display case has a display section 184 in which there are arranged a plurality of display shelves 186, 188, 190, and 192. Access to the refrigerated products on the display shelves is obtained by opening one of the doors 182 and reaching into the case through opening 180.

Surrounding display section 184 is a single air conduit 194. Air conduit 194 extends along top wall 172, rear wall 174 and bottom wall 176 of the display case. Conduit 194 has an outlet opening 196 arranged near the top of the display case and an inlet opening 198 arranged near the bottom of the display case. Outlet opening 196 and inlet opening 198 are arranged in aerodynamic alignment so that air expelled through opening 196 is directed along a substantially vertical path towards and into inlet opening 198 so as to form a vertically extending air curtain across opening 180 in the front of display case 170. This air curtain is positioned inside of glass door 182.

Arranged within air conduit 194 is at least one fan 200 and an evaporator coil 202, or a plurality of such evaporator coils. Both fan 200 and evaporator coil 202 are arranged in the bottom portion of the air conduit. Fan 200 is positioned upstream of evaporator coil 202 so that the fan creates a positive pressure air flow through the coils during the refrigeration cycle of operation. Such a positive pressure air flow provides for better and more efficient air circulation than if the fan was located downstream of the coil, where it would rely on a suction or drawing action of the air through the coil.

During a refrigeration cycle of operation of display case 170, air is circulated by fan 200 through air conduit 194 so as to pass through evaporator coil 202. As the air passes through evaporator coil 202 it is refrigerated. Such refrigerated air is then expelled out of conduit 194 through outlet opening 196 along a path across opening 180 and back into inlet opening 198, where such air is then recirculated and again refrigerated.

It is intended that the display case of the present invention, such as represented by the exemplary embodiment illustrated in the drawings, employ ambient air for purposes of defrosting both the interior of air conduit 194 and evaporator coil 202. Inasmuch as the front of the display case is covered by glass door 182, a mechanism must be provided for enabling ambient air from outside of the display case to be drawn into the case and passed through the conduit without such air entering display section 184.

In order to enable ambient air to be drawn into the air conduit during a defrost cycle of operation, the display case can be provided with an aperture in top wall 172. During the refrigeration cycle of operation, aperture 204 is closed by an appropriate closure member which will be described below. In addition, door 182 is opened during the defrost cycle of operation for enabling the ambient air that has passed through the conduit to be expelled from the display case.

First considering aperture 204 in top wall 172 of the display case, this aperture is closed by a top gate mechanism 206 during the refrigeration cycle of operation. Gate mechanism 206 includes a motor 208, a first arm 210 and a second arm 212 attached by pivot pin 213. At the end of arm 212 a closure member 214 is pivotally affixed. The gate mechanism in its normal position has arms 210 and 212 arranged so that closure member 214 is inserted into aperture 204 and sits against seat 216 in the top of the display case. Attached to closure member 214 is a blocking member 218. During the refrigeration cycle of operation, blocking member 218 allows air to pass through the upper portion of the air conduit so as to be expelled through outlet opening 196. The positions of the gate mechanism and the associated elements during a refrigeration cycle of operation are shown in FIG. 7. During the defrost cycle of operation shown in FIG. 8, motor 208 pivots arms 210 and 212 so as to lift closure member 214 up and away from aperture 204, thereby allowing air to be drawn into conduit 194 through aperture 204 when the air flow direction is reversed. Simultaneously with the upward movement of closure member 214, blocking member 218 is pivoted into a position for substantially blocking the air flow through the conduit so as to prevent air from the display section from being drawn into air conduit 194 and on through outlet opening 196. Thus, the ambient air which is drawn into conduit 194 is prevented from being expelled through outlet opening 196 into display section 184 of display case 170.

In order to open the door during the defrost cycle, either a single motor with a transmission linkage-operator rod coupling it to each door or a separate motor for each door can be arranged on the top of the display case. Motor 220 is coupled to transmission linkage 222 for pushing open door 182. As shown in FIG. 7, a plurality of transmission linkages can be interconnected through an operator rod 224. Each door of a multiple set can be pivoted about its hinges when the door operating mechanisms are activated so as to slightly open doors by a distance G (see FIG. 4) of approximately 1 to 7 inches along the free vertical edge of the door. The vertical rotatable rod 226 and the door opening lever 228 can be seen in FIG. 8.

The open door enables the ambient air emitted from air conduit 194 through opening 198 during the defrost cycle to be expelled from display case 170. To assist in the expulsion of the air through the open door, walls 230 and 232 of conduit 194 can be slanted outwardly, such as shown in FIGS. 7 and 8. This formation of walls 230 and 232 helps to direct the ambient air leaving opening 198 in a direction out of the open door and away from the display case.

Thus, during a defrost cycle of operation of the display case, closure member 214 is pivoted out of its aperture 204 and door 182 is opened. The operation of fan 200 is reversed so that air flows through air conduit 194 in a direction opposite the air flow during a refrigeration cycle. With this reverse flow of air, ambient air from outside of the display is drawn in through aperture 204 into conduit 194. The ambient air flows along the portion of the conduit adjacent to the rear wall of display case 170. Such ambient air then flows through evaporator coil 202 and out of the open doors. The ambient air serves to defrost both the interior of conduit 194 and evaporator coil 202. The air flow paths during the refrigeration cycle and defrost cycles of operation are shown by the arrows in FIGS. 7 and 8.

During the refrigeration cycle of operation, it is possible for condensation to accumulate on the grill work at the inlet opening. Such condensation can eventually lead to a buildup of frost, thereby blocking the openings in the grill work. In order to minimize such a condition, liquid lines 232 can be provided adjacent each of the openings of the grill work at inlet opening 198. Such liquid lines contain liquid refrigerant which is in the process of being carried towards the evaporator coil. Since such liquid refrigerant is warmer than the air passing through inlet opening 198, the liquid refrigerant serves to eliminate the buildup of condensation and frost on the grill covering the inlet opening.

In an alternative embodiment of the present invention, in refrigerated display cases, ambient air is drawn into air conduit 194 through the gap G created by open door 182 instead of an aperture in top wall 172. The air flow during the refrigeration cycle of operation of such display cases is the same as FIG. 7. During the defrost cycle of operation of display case 170, ambient air is drawn through the tops of open door 182 into air conduit 194 through air outlet opening 196. The ambient air then is circulated through the air conduit and leaves the conduit through air inlet opening 198. After the ambient air leaves air conduit 194 it is expelled from the display case through the gap created by the partially opened door.

Other alternative embodiments of refrigerated merchandiser display cabinets which can be defrosted by use of the door operating mechanism of the present invention are disclosed in the copending above-referenced application entitled REFRIGERATED MERCHANDIZER DISPLAY CASE filed Apr. 18, 1980 by Fayez F. Ibrahim. Also, the door operating mechanism can be used with retrofitted door assemblies for a wide range of types of display cabinets such as disclosed in the copending application entitled MERCHANDIZER DISPLAY CASE ADAPTED FOR ENERGY CONSERVATION filed Apr. 18, 1980. The control means for operating the refrigeration and defrost cycles in cabinets 10 and 170 of the present invention is identical with those disclosed in these two copending applications which have been incorporated herein by reference.

The door operating means of the present invention comprises one or more motive means shown as motor and gear box assemblies, a motion take-up means for independent operation for each door, and door opening means for each barrier door. The motive means can be ganged or distributed across the longitudinal length of the display cabinet. If desired, the motion take-up means providing for separate closing of the doors by outside forces can be included in the gear box of the motive means so that the assemblies such as 122 in FIGS. 1-6 are self contained. This embodiment eliminates the need for the operator rod 120 and the door opening lever can be directly operated by such assemblies.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a refrigerated display cabinet having at least one openable door for enabling communication of the outside atmosphere with the inside of said display cabinet, the improvement comprising:

a door operating mechanism for selectively moving said door from a closed to a partially opened position; said mechanism including a motive means connected to a power transmission means, said transmission means connected to a door opening means; said motive means transmitting a force to said door opening means through said power transmission means for enabling the opening of said door, said door operating mechanism including a motion take-up means for enabling closure of said door by an outside force independently of said motive means and for enabling automatic reopening of said door after said outside force is removed.

2. The improvement according to claim 1, wherein said motion take-up means returns said door opening means to the open position when the outside force is removed.

3. The improvement according to claim 1, wherein said motion take-up means consists of a spring-biased follower pin and a motion take-up slot, and wherein said follower pin is connected to said door opening means and said take-up slot is integrally formed in said transmission means.

4. The improvement according to claim 1, wherein said door opening means comprises a door lever arm integrally connected to a door opening lever which contacts said door for opening the same, and wherein said motive means transmits force through said motion take-up means to said door lever arm.

5. The improvement according to claim 1, wherein said motive means comprises a prime mover means, and wherein said door operating mechanism includes a power transmission means attached to said prime mover means and an operator rod attached to said transmission means for moving said door opening means.

6. The improvement according to claim 5, wherein a motion take-up slot is integrally formed in said operator rod and wherein a spring-biased follower pin is positioned for slidable movement within said slot and is integrally connected to said door opening means.

7. The improvement according to claim 5, wherein a motion take-up slot is integrally formed in said operator rod and wherein a spring-biased follower pin is positioned for slidable movement within said slot and is integrally connected to a door lever arm which transmits force to open said door.

8. The improvement according to claim 1, wherein said door operating mechanism further comprises:

a plurality of motive means connected through power transmission means to at least one operator element, said operator element transmitting force through said motion take-up means to at least one door operating means which transmits force to partially open said door.

9. The improvement according to claim 8, wherein said display cabinet has multiple doors and wherein said operator element transmits force to a separate door operating means for each of said multiple doors.

10. The improvement according to claim 1, wherein said motive means includes an operator rod movably mounted with respect to said display cabinet for the transmission force to said door opening means.

11. The improvement according to claim 1, wherein said motive means comprises a prime mover means, a power transmission means connected to said prime mover means and including an operator rod having a motion take-up slot integrally formed therein, a follower pin slidably positioned within said slot and spring-biased against one end of said slot by a tension spring, said follower pin integrally connected to said door opening means to enable a partial opening of said door upon operation of said motive means and said tension spring enabling movement of said follower pin within said slot to accommodate an outside closing force when exerted against said door.

12. The improvement according to claim 11, wherein said door opening means is movable to partially open said door through force exerted by said prime mover means through said power transmission means and said tension spring, and wherein said door opening means is movable in an opposite direction to permit closing of said door independently of functioning of said power transmission means by exertion of a closing force against said door through the increasing of the tension on said spring.

13. The improvement according to claim 11, wherein said display cabinet is provided with multiple doors and wherein a plurality of motive means are provided for moving said operator rod, said rod having multiple longitudinal slots formed therein and each slot containing a follower pin connected to a door opening means, a separate door opening means included for enabling opening of each of said multiple doors.

14. The improvement according to claim 11, wherein said tension spring has a tensile force of at least 12 pounds.

15. In a refrigerated display cabinet having an access opening and at least one openable door for covering said access opening and for enabling communication of the outside atmosphere with the inside of said display cabinet; the improvement comprising:

a door operating mechanism having a force output for selectively creating a gap between said door and said access opening, said door operating mechanism enabling repeated closures of said door by an outside force independently of the force output from said mechanism and automatic reopening of said door after said outside force is removed.

16. The improvement according to claim 15, wherein said refrigerated cabinet has means associated therewith for operating said cabinet through at least one refrigeration cycle and one defrost cycle and wherein said door operating mechanism is activated in response to defrost requirements of said display cabinet following said defrost cycle and wherein ambient air is moved through the gap created between said door and said access opening during a defrost cycle of operation of said cabinet.

17. The improvement according to claim 16, wherein said door operating mechanism includes a motion take-up means for enabling closure of said door by exertion of an outside force independently of said door operating means.

18. The improvement according to claim 15, wherein said door operating mechanism includes a motive means connected to a power transmission means, said transmission means connected to a door opening means, said motive means transmitting a force to said door opening means through said power transmission means for enabling the opening of said door, and said door operating mechanism including a motion take-up means for enabling closure of said door by an outside force independently of said motive means.

19. The improvement according to claim 15, wherein said door operating mechanism enables the gap between said door and said access opening to be reestablished when the outside force is removed.

20. The improvement according to claim 18, wherein said motion take-up means consists of a spring-biased follower pin and a motion take-up slot, and wherein said follower pin is connected to said door opening means and said take-up slot is integrally formed in said transmission means.

21. The improvement according to claim 18, wherein said motive means comprises a prime mover means, a power transmission means attached to said prime mover means, and an operator rod attached to said transmission means; said operator rod having a motion take-up slot integrally formed therein and a spring-biased follower pin slidably positioned within said slot, said follower pin integrally connected to a door lever arm for transmitting force to open said door.

22. The improvement according to claim 18, wherein said door opening mechanism further comprises:

a plurality of motive means connected through power transmission means to at least one operator element, said operator element transmitting force through said motion take-up means to at least one door operating means which transmits force to create the gap between said door and said access opening.

23. The improvement according to claim 18, wherein said motive means comprises a prime mover means which is connected to said power transmission means, said motion take-up means comprising a slot integrally formed in said transmission means, a follower pin slidably positioned within said slot and spring-biased against one end of said slot by a tension spring, said follower pin integrally connected to said door opening means to enable creation of the gap between said door and said access opening upon operation of said motive means and, said tension spring enabling movement of said follower pin within said slot to accommodate a closing force when exerted against said door.

24. The improvement according to claim 18, wherein said door opening means is activated to create the gap between said door and said access opening through force exerted by said motive means, and wherein said door opening means is movable in an opposite direction to permit closing of said door independently of functioning of said power transmission means by exertion of a closing force against said door through the increasing of the tension of said spring.

25. In a display cabinet having refrigeration means and a display space therein, aperture means in at least one wall of said cabinet for communicating ambient outside air with the air in said cabinet, said aperture means comprising an access opening for permitting products to be moved into and out of said display space, air moving means for circulating at least one air band within said cabinet and into contact with said refrigeration means during a refrigeration cycle, covering means for said aperture means including a barrier door for substantially covering said access opening, and said refrigeration means including a low temperature element; the improvement comprising: air defrost means including a door operating mechanism for selectively creating a gap between said barrier door and said access opening; said door operating mechanism enabling repeated closures of said door by an outside force independently of the functioning of said door operating mechanism, said air defrost means causing said air moving means to pass ambient air through said cabinet and through the gap between said barrier door and said access opening during a defrost cycle to bring the ambient air into contact with said low temperature element to remove frost therefrom and to thereafter eject the defrost ambient air from said cabinet; and, control means for selectively operating said air defrost means and said refrigeration means to defrost said low temperature element during a defrost cycle and to refrigerate said cabinet during a refrigeration cycle.

26. The improvement according to claim 25 wherein said door operating mechanism includes a motion take-up means for enabling closure of said door by exertion of an outside force independently of said door operating mechanism.

27. The improvement according to claim 25, wherein said aperture means includes an air passage port in a wall of said cabinet, and wherein said air moving means passes ambient air through said cabinet by moving air through said air passage port and through the gap between said barrier door and said access opening during a defrost cycle.

28. The improvement according to claim 25, wherein said aperture means includes an air passage port in a wall of said cabinet, and wherein said air moving means draws ambient air into said cabinet through said air passage port and ejects defrost ambient air through the gap between said barrier door and said access opening during a defrost cycle.

29. The improvement according to claim 25, wherein during a defrost cycle said door operating mechanism creates the gap between said barrier door and said access opening and causes said air moving means to draw ambient air into said cabinet through a first portion of said gap and to eject the defrost ambient air through a second portion of said gap.

30. The improvement according to claim 25, wherein during a defrost cycle said door operating mechanism selectively creates the gap between said barrier door and said access opening and permits said barrier door to substantially cover said access opening during a refrigeration cycle to thereby conserve operating energy for said display cabinet.

31. The improvement according to claim 25, wherein said air moving means for circulating at least one air band within said cabinet comprises a first air circulation means for propelling a primary refrigerated air band, and a second air circulation means for selectively propelling a secondary air guard band in the same direction as said primary air band during a refrigeration cycle and for drawing ambient air into said secondary air band and then propelling the ambient air through said cabinet in a reverse direction to said refrigerated air band and into contact with said low temperature element during a defrost cycle.

32. The improvement according to claim 31, wherein said control means contains means for reducing the refrigeration function of said refrigeration means at the beginning of a defrost cycle, causing said door operating mechanism to create a gap between said barrier door and said access opening, and reversing the flow of said secondary air band from the direction of flow of said primary refrigeration air band during a refrigeration cycle to the opposite direction, drawing ambient air through the gap into said cabinet, and moving said ambient air over said low temperature element of said refrigeration means to defrost the same, and to thereafter eject the defrost ambient air through said aperture means.

33. The improvement according to claim 25, wherein said moving means includes an auxiliary air circulation means for increasing ambient air inflow into said display cabinet and for commingling the ambient air with said air band during a defrost cycle.

34. The improvement according to claim 25, wherein said air moving means for circulating at least one air band within said cabinet comprises a first air circulation means for propelling a primary refrigerated air band during a refrigeration cycle, and a secondary air circulation means for propelling a secondary air guard band in the same direction as said primary air band during a refrigeration cycle, said air defrost means selectively reversing the direction of flow of said primary air band and terminating operation of said refrigeration means and of said secondary air circulation means during a defrost cycle to prevent flow of said secondary air guard band whereby ambient air is passed through said cabinet by said primary air band.

35. The improvement according to claims 31 or 34, wherein said secondary air circulation means is prevented from propelling said secondary air band during portions of the refrigeration cycle in which said barrier door is not opened.

36. The improvement according to claims 31 or 34, wherein said control means contains sensing means for detecting the opening of said barrier door and wherein said control means operates said secondary air circulation means for propelling said secondary air band in the same direction as said primary refrigerated air band selectively in response to the opening of said barrier door during a refrigeration cycle.

37. The improvement according to claims 31 or 34, wherein said control means includes means for sensing the refrigeration condition within said display space and means for selectively operating said air moving means to propel said secondary air band in the same direction as said primary refrigerated air band depending upon the refrigeration condition sensed.

38. The improvement according to claim 25, wherein said air moving means for circulating at least one air band comprises a first air circulation means for selectively propelling a primary refrigerated air band within a primary conduit contained in said cabinet, and a second air circulation means for selectively propelling a second air guard band within a secondary conduit contained in said cabinet in the same direction as said primary air band during a refrigeration cycle; said air defrost means during a defrost cycle of operation terminating operation of said second air circulation means and causing said primary air band to draw ambient air from outside said cabinet and to contact said low temperature element with said primary air band containing the ambient air.

39. The improvement according to claim 38, wherein during a defrost cycle of operation defrost ambient air is discharged from said cabinet through the gap between said barrier door and said access opening.

40. The improvement according to claim 38, wherein said air moving means includes an auxiliary air circulation means for increasing ambient air inflow into said display cabinet and for comingling the ambient air with said primary air band during a defrost cycle of operation in which the direction of air flow is maintained the same as in a refrigeration cycle, and wherein the defrost ambient air is discharged from said cabinet through the gap between said barrier door and said access opening.

41. A display cabinet according to claim 25, wherein during a defrost cycle said door operating mechanism creates the gap between said barrier door and said access opening and said air moving means draws ambient air into said cabinet through a first portion of the gap and ejects the defrost ambient air through a second portion of the gap.

42. A display cabinet according to claim 25, wherein said door operating mechanism selectively creates a gap of preset distance between said barrier door and said access opening.

43. A display cabinet according to claim 25, wherein said door operating mechanism selectively creates a gap of variable distance between said barrier door and said access opening depending upon the amount of frost accumulation on said refrigeration means and the time period for the defrost cycle.

44. A display cabinet according to claims 42 or 43, wherein the gap distance between said barrier door and said access opening is approximately 1 to 7 inches.

45. In a display cabinet having refrigeration means and a display space therein accessible through at least one access opening, at least one barrier door for substantially covering said access opening, and means for providing a plurality of air bands for selective circulation within said cabinet to maintain a flow pattern inside of said cabinet adjacent to said barrier door, wherein at least one of said air bands is cooled by contact with said refrigeration means; the improvement comprising: air defrost means including a door operating mechanism having a force output for selectively creating a gap between said barrier door and said access opening for enabling passage of ambient air at least into said air band in contact with said refrigeration means to remove frost therefrom during a defrost cycle of operation; said door operating mechanism enabling repeated closures of said door by an outside force independently of the functioning of said door operating mechanism and automatic reopening of said door after said outside force is removed.

46. The improvement according to claim 45, wherein a plurality of barrier doors are attached to said display cabinet for substantially covering said access opening, and wherein said door operating mechanism selectively creates a gap between at least alternate doors in the series of said barrier doors and said access opening during a defrost cycle of operation.

47. The improvement according to claim 46, wherein said door operating mechanism creates a gap between substantially all of said barrier doors and said access opening simultaneously.

48. The improvement according to claim 26, wherein said barrier doors contain therein a transparent material viewing port.

49. The improvement according to claim 46, wherein a series of door operating mechanisms are arranged for individually and selectively creating gaps between each of said barrier doors and said access opening during a defrost cycle.

50. The improvement according to claim 46, wherein said door operating mechanism selectively creates gaps between at least alternate doors in a series of said barrier doors and said access opening.

51. A method of operating a refrigerated display cabinet comprising a cabinet having a display space therein, and aperture means in at least one wall thereof for communicating ambient outside air with the air in the cabinet, the aperture means comprising an access opening for permitting products to be moved into and out of the display case, covering means for the aperture means including a barrier door for substantially covering the access opening, the barrier door being movable for enabling access to the cabinet, at least one air conduit extending about the display space and having an outlet opening and an inlet opening at opposite ends thereof, with the outlet opening and the inlet opening being arranged in aerodynamic alignment so that air leaving the air conduit outlet opening will be directed toward and received by the inlet opening, and an air moving means for propelling a refrigerated air band through the air conduit during a refrigeration cycle and for propelling ambient air through the cabinet during a defrost cycle, and a refrigeration means arranged within the air conduit; the method comprising the steps of:

selectively operating the display cabinet in a refrigeration cycle of operation and in a defrost cycle of operation; during a refrigeration cycle, circulating the air band through the air conduit so that air is expelled from the outlet opening and received by the inlet opening so as to form an air curtain across the access opening in the cabinet along a path inside of the barrier door, and propelling the air band through the refrigeration means; during a defrost cycle of operation, terminating operation of the refrigeration means, causing ambient air to be drawn into the cabinet, pass through a substantial portion of the air conduit, and across the refrigeration means, causing the defrost ambient air to be ejected from the cabinet, creating a gap between the barrier door and the access opening to enable ambient air through-flow, and providing for closing of the gap by outside force and reestablishment of the gap when the force is removed; whereby ambient air is drawn into the air band and across the refrigeration means to defrost the same by communicating ambient air with the air band in the display cabinet.

52. A method according to claim 51, wherein said creating of a gap between the barrier door and the access opening is accomplished by transmission of force from a prime mover means through an operator element having a motion take-up means integrally formed therein, and wherein said motion take-up means enables closing of the gap by outside force.

53. A method according to claim 51, wherein a plurality of barrier doors are provided for covering the access opening, and wherein said step of creating gaps between the barrier doors and the access opening is accomplished by means of force transmitted from a prime mover means through a motion take-up means separably operative for each of said plurality of doors, and wherein said take-up means functions independently for each of the plurality of doors to accommodate closing of the gap for each of the doors independently by an outside force and wherein said take-up provides for reestablishment of each gap when the independent force is removed therefrom.

54. The improvement according to claim 1, wherein said refrigerated cabinet has means associated therewith for operating said cabinet through at least one refrigeration cycle and at least one defrost cycle and wherein said door operating mechanism is activated in response to defrost requirements of said display cabinet following said defrost cycle, and wherein ambient air is moved through the gap created between said door and said display cabinet during a defrost cycle of operation of said cabinet.

* * * * *

UNITED STATES PATENT AND TRADEMARK OFFICE

CERTIFICATE OF CORRECTION

PATENT NO. : 4,341,083

DATED : July 27, 1982

INVENTOR(S) : Ibrahim et al

It is certified that error appears in the above—identified patent and that said Letters Patent is hereby corrected as shown below:

Column 1, line 17, change "retain" to --retail--;

, line 23, change "as" to --at--.

Column 3, line 18, change "tripple" to --triple--.

Column 19, line 14, change "comingling" to --commingling--.

Column 20, line 3, change "26" to --46--.

Signed and Sealed this

*Eleventh* Day of *January 1983*

[SEAL]

*Attest:*

GERALD J. MOSSINGHOFF

*Attesting Officer*

*Commissioner of Patents and Trademarks*